US008791683B1

(12) United States Patent
Porter et al.

(10) Patent No.: US 8,791,683 B1
(45) Date of Patent: Jul. 29, 2014

(54) VOLTAGE-MODE BAND-GAP REFERENCE CIRCUIT WITH TEMPERATURE DRIFT AND OUTPUT VOLTAGE TRIMS

(75) Inventors: Edson Wayne Porter, Colorado Springs, CO (US); Iulian Constantin Gradinariu, Colorado Springs, CO (US)

(73) Assignee: Linear Technology Corporation, Milpitas, CA (US)

( * ) Notice: Subject to any disclaimer, the term of this patent is extended or adjusted under 35 U.S.C. 154(b) by 552 days.

(21) Appl. No.: 13/037,090

(22) Filed: Feb. 28, 2011

(51) Int. Cl.
*G05F 1/59* (2006.01)
*G05F 1/595* (2006.01)

(52) U.S. Cl.
USPC ..... 323/313; 323/281; 323/907

(58) Field of Classification Search
USPC ..... 323/269–270, 275, 280–281, 312–317, 323/907; 327/535, 538, 539
See application file for complete search history.

(56) References Cited

U.S. PATENT DOCUMENTS

| | | | | |
|---|---|---|---|---|
| 3,887,863 | A * | 6/1975 | Brokaw | 323/314 |
| 4,795,961 | A * | 1/1989 | Neidorff | 323/314 |
| 4,939,442 | A * | 7/1990 | Carvajal et al. | 323/281 |
| 5,391,980 | A * | 2/1995 | Thiel et al. | 323/314 |
| 5,619,163 | A * | 4/1997 | Koo | 327/539 |
| 5,767,664 | A * | 6/1998 | Price | 323/313 |
| 6,329,804 | B1 | 12/2001 | Mercer | |
| 6,342,781 | B1 * | 1/2002 | Laraia | 323/313 |
| 6,346,848 | B1 * | 2/2002 | Shkap | 327/538 |
| 6,462,526 | B1 * | 10/2002 | Tanase | 323/313 |
| 6,642,699 | B1 * | 11/2003 | Gregoire, Jr. | 323/314 |
| 6,891,358 | B2 * | 5/2005 | Marinca | 323/316 |
| 6,906,581 | B2 * | 6/2005 | Kang et al. | 327/539 |
| 7,262,586 | B1 * | 8/2007 | Gradinariu | 323/280 |
| 7,420,359 | B1 | 9/2008 | Anderson et al. | |
| 2007/0152740 | A1 * | 7/2007 | Georgescu et al. | 327/539 |
| 2012/0206284 | A1 * | 8/2012 | Gradinariu | 341/144 |

* cited by examiner

*Primary Examiner* — Adolf Berhane
*Assistant Examiner* — Nusrat Quddus
(74) *Attorney, Agent, or Firm* — McDermott Will & Emery LLP

(57) ABSTRACT

A monolithic voltage reference circuit may include a voltage-mode band-gap reference circuit, a temperature independent differential current source, and a temperature dependent differential current source. The voltage-mode band-gap reference circuit may include an error amplifier having differential input nodes. The temperature independent differential current source may be configured to add in or subtract from the differential input nodes a substantially temperature independent differential current with an allocation between the nodes that is controlled by a selectable output voltage trim setting. The temperature dependent differential current source may be configured to add in or subtract from the differential input nodes a substantially temperature dependent differential current with an allocation between the nodes that is controlled by a selectable temperature drift trim setting.

19 Claims, 8 Drawing Sheets

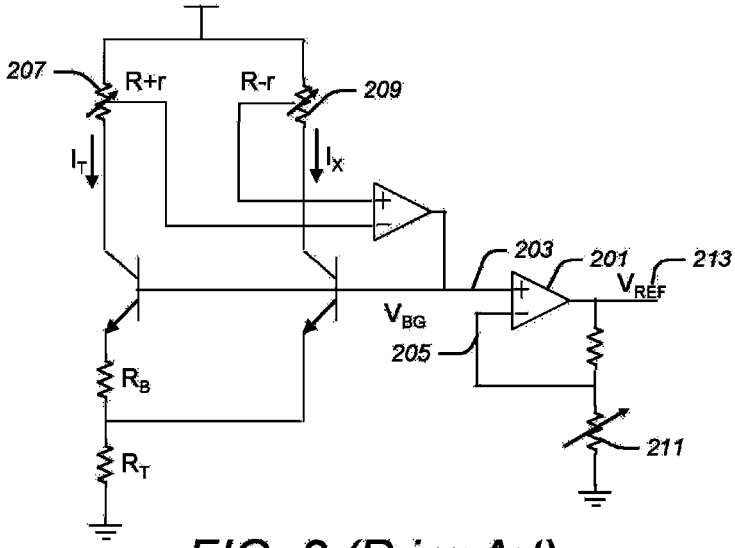
FIG. 2 (Prior Art)
FIG. 3 (Prior Art)
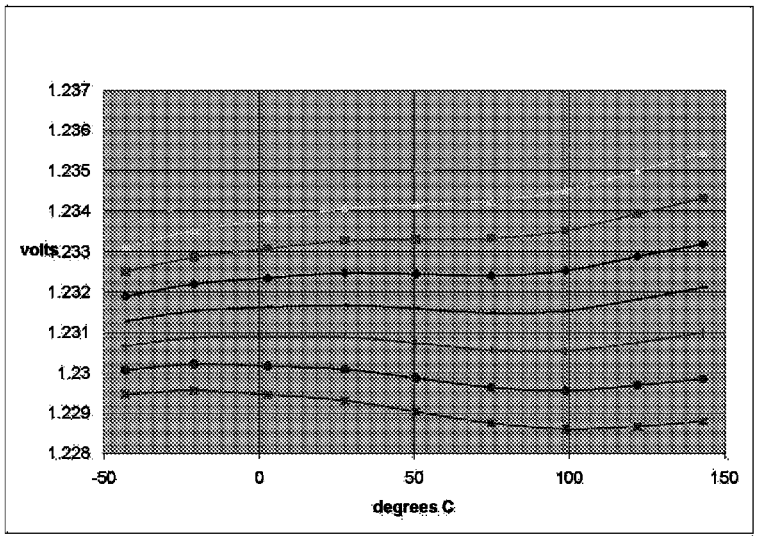

FIG. 7
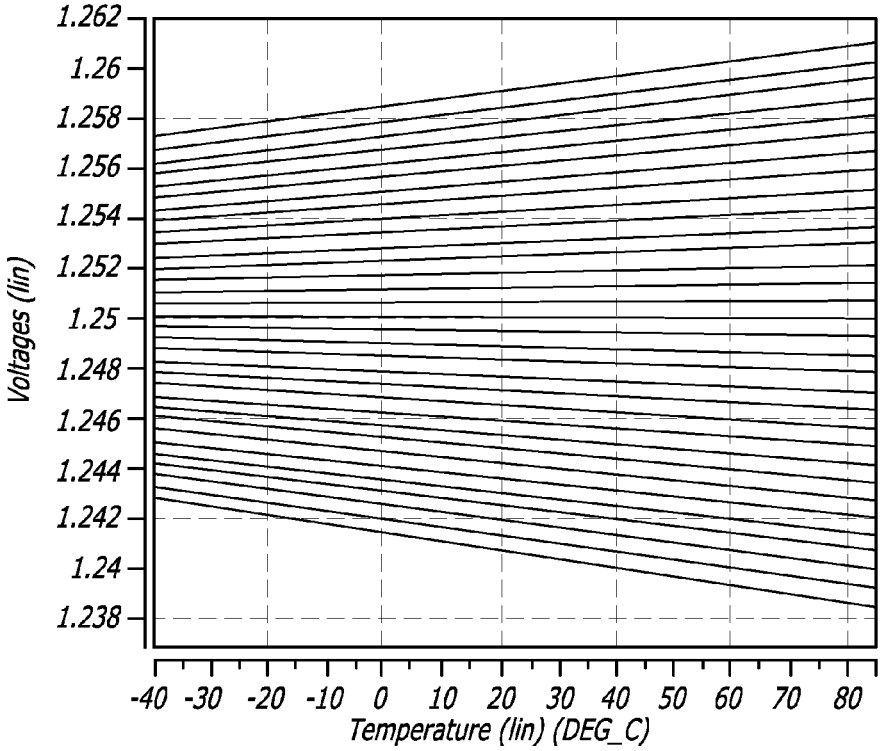
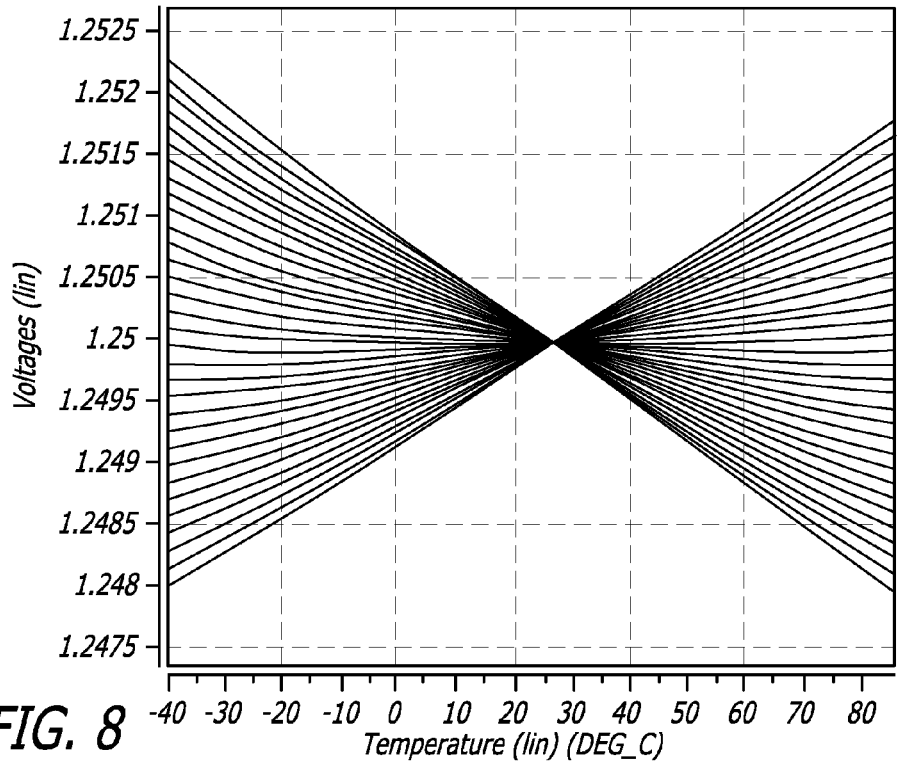
FIG. 8

VOLTAGE-MODE BAND-GAP REFERENCE CIRCUIT WITH TEMPERATURE DRIFT AND OUTPUT VOLTAGE TRIMS

BACKGROUND

1. Technical Field

This disclosure relates to trimming voltage-mode band-gap reference circuits to a desired output voltage which meets a temperature drift specification.

2. Description of Related Art

Various applications may require a reference voltage that meets a temperature drift specification, such as digital-to-analog converters. A voltage reference circuit, such as a voltage-mode band-gap reference circuit, may be used to provide this reference voltage. Examples of such circuits are set forth in U.S. Pat. Nos. 7,420,359 and 6,329,804.

A voltage-mode band-gap reference circuit may exhibit its greatest temperature stability at a particular voltage, commonly known as the "magic" voltage of the circuit. However, it may be difficult to generate an output voltage which is near or below this magic voltage.

A voltage-mode band-gap reference circuit may use a second stage to generate the output voltage. However, the second stage may introduce noise which may be difficult to filter.

A voltage-mode band-gap reference circuit may require a supply voltage which is much higher than the magic voltage. Such a high supply voltage, however, may be unavailable in certain applications.

A voltage-mode band-gap reference circuit may be difficult and time consuming to trim.

SUMMARY

A monolithic voltage reference circuit may include a voltage-mode band-gap reference circuit, a temperature independent differential current source, and a temperature dependent differential current source. The voltage-mode band-gap reference circuit may include an error amplifier having differential input nodes. The temperature independent differential current source may be configured toadd in or subtract from the differential input nodes a substantially temperature independent differential current with an allocation between the nodes that is controlled by a selectable output voltage trim setting. The temperature dependent differential current source may be configured to add in or subtract from the differential input nodes a substantially temperature dependent differential current with an allocation between the nodes that is controlled by a selectable temperature drift trim setting.

The temperature independent differential current source may be configured to provide incremental selectable output voltage trim settings, the incremental selection of which causes a corresponding incremental change in the output voltage of the monolithic voltage reference circuit at a certain temperature. The temperature dependent differential current source may be configured to provide incremental selectable temperature drift trim settings, the incremental selection of which causes substantially the same corresponding incremental change in the output voltage of the monolithic voltage reference circuit at the same temperature.

Each differential current source may include a potentiometer connected between the differential input nodes which has a controllable cursor whose position sets the selectable trim setting of the differential current source. The potentiometers of the two differential current sources may be connected substantially in parallel. The cursor of the potentiometer of the temperature independent differential current source may be connected to a voltage supply line. The potentiometers of the two differential current sources may instead be connected substantially in series.

Each differential current source may include an R2R resistor ladder.

One of the differential current sources may be configured to inject current into the differential input nodes, while the other differential current source may be configured to subtract current from the differential input nodes.

Each differential current source may be configured to cause the sum of the differential currents which it injects into or subtracts from the differential input nodes to be substantially constant, notwithstanding changes in the selectable trim setting of the differential current source.

Both differential current sources may be within the voltage-mode band-gap reference circuit. The voltage-mode band-gap reference circuit may have a magic voltage at which the temperature stability of the circuit is maximized. The voltage-mode band-gap reference circuit may be configured to operate with a supply voltage which is not substantially larger than the magic voltage. The selectable output voltage trim setting may be set to cause the output voltage to be near or below the magic voltage.

A monolithic voltage reference circuit which has selectable temperature drift trim settings and selectable output voltage trim settings may be trimmed after it is manufactured. The trimming process may cause the monolithic voltage reference circuit to be at a first temperature. While at the first temperature, the process may identify sets of trim settings. Each set of trim setting may consist of a selectable temperature drift trim setting and a selectable output voltage trim setting which collectively cause an output of the monolithic voltage reference circuit to be substantially at a pre-determined level which is substantially the same for each set. The process may cause the monolithic voltage reference circuit to be at a second temperature which is different from the first temperature. While at the second temperature, the process may identify one of the sets of trim settings which causes the monolithic voltage reference circuit to meet a temperature drift specification. The process may set the temperature drift trim setting and the output voltage trim setting of the monolithic voltage reference circuit to their respective values in the identified set of trim settings.

The process of identifying the one set of trim settings may include identifying the one set of trim settings which causes the output of the monolithic voltage reference circuit to exhibit the lowest temperature drift.

The first temperature may be room temperature and the second temperature may be higher than the room temperature.

The process of identifying the sets of trim settings may include setting the monolithic voltage reference circuit to each of the temperature drift trim settings and, while set at each temperature drift trim setting, finding the output voltage trim setting which causes the output of the monolithic voltage reference circuit to be substantially at the pre-determined level.

The process of identifying the sets of trim settings may include setting the monolithic voltage reference circuit to each of the output voltage trim settings and, while set at each output voltage trim setting, finding the temperature drift trim setting which causes the output of the monolithic voltage reference circuit to be substantially at the pre-determined level.

The monolithic voltage reference circuit may be a voltage mode band-gap reference circuit.

These, as well as other components, steps, features, objects, benefits, and advantages, will now become clear from a review of the following detailed description of illustrative embodiments, the accompanying drawings, and the claims.

BRIEF DESCRIPTION OF DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

FIG. 2 illustrates a prior art example of voltage-mode band-gap reference circuit which provides a temperature drift trim setting and an output voltage trim setting.

FIG. 3 illustrates a prior art example of the temperature stability of the voltage-mode band-gap reference circuit illustrated in FIG. 2 as a function of different temperature drift trim settings.

FIG. 7 illustrates an example of the effect of different temperature drift trim settings in the temperature dependent differential current source illustrated in FIG. 5.

FIG. 8 illustrates an example of the effect of different sets of paired output voltage trim settings and temperature drift trim settings in the voltage-mode band-gap reference circuit illustrated in FIG. 5.

DETAILED DESCRIPTION OF ILLUSTRATIVE EMBODIMENTS

Illustrative embodiments are now described. Other embodiments may be used in addition or instead. Details which may be apparent or unnecessary may be omitted to save space or for a more effective presentation. Some embodiments may be practiced with additional components or steps and/or without all of the components or steps which are described.

Figure 1:
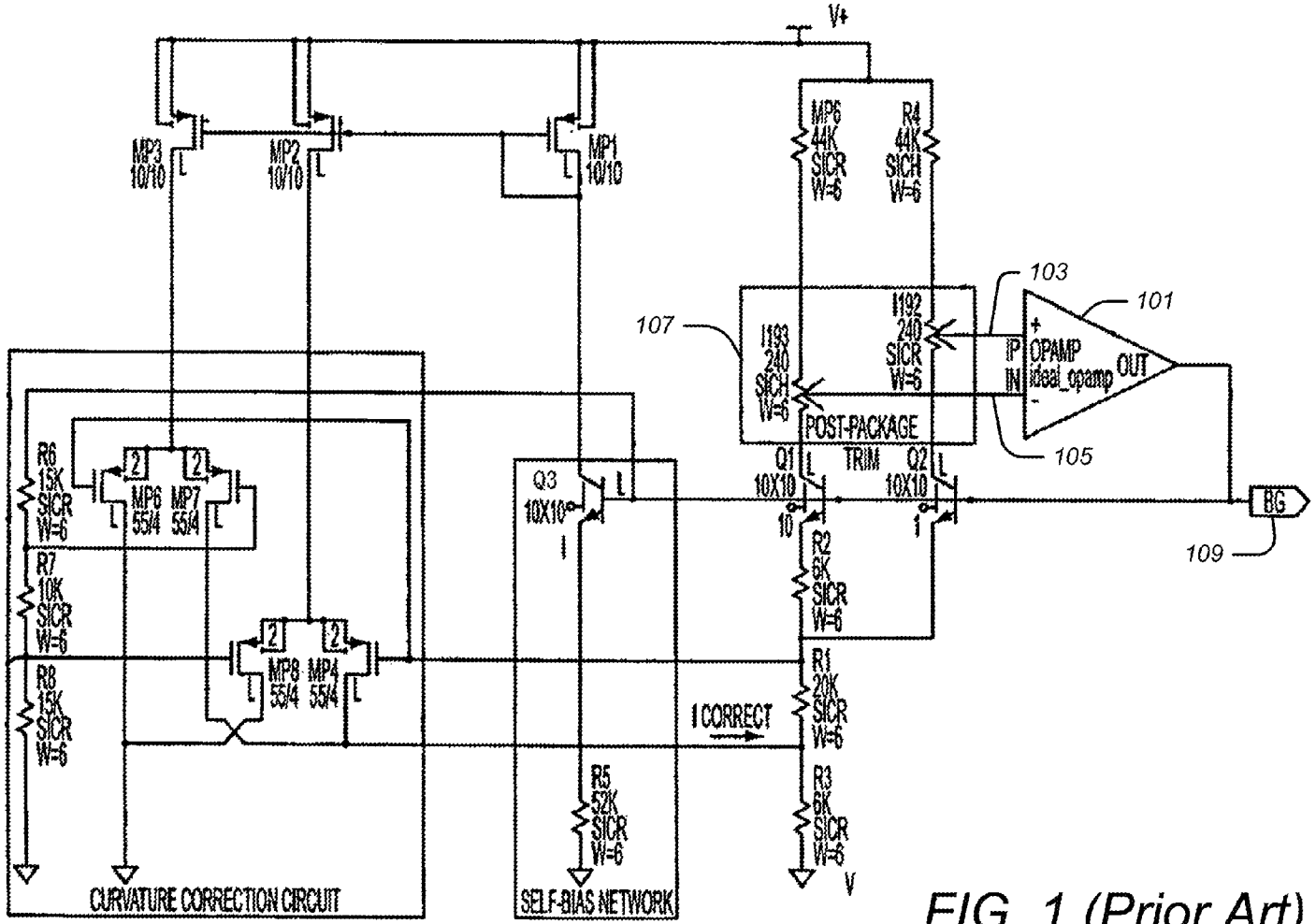
FIG. 1 (Prior Art)
FIG. 1 illustrates a prior art example of a voltage-mode band-gap reference circuit which provides a temperature drift trim setting.

FIG. 1 illustrates a prior art example of a voltage-mode band-gap reference circuit which provides a temperature drift trim setting.

The voltage-mode band-gap reference circuit includes an error amplifier 101 having differential input nodes 103 and 105 and a post-packaged trim 107 provides temperature drift trim settings which may be adjusted after production of the package. An output 109 of the circuit may be adjusted by an additional circuit to provide a desired output voltage. More details about the circuit illustrated in FIG. 1 are set forth in U.S. Pat. No. 7,420,359, which is incorporated herein by reference.

FIG. 2 illustrates a prior art example of voltage-mode band-gap reference circuit which provides a temperature drift trim setting and an output voltage trim setting. FIG. 2 is a simplified example of the circuit illustrated in FIG. 1 with an added gain trim stage. The circuit includes an error amplifier 201 with differential input nodes 203 and 205, temperature drift trim potentiometers 207 and 209 which may be adjusted to minimize temperature drift, and output voltage trim potentiometer 211 which may be adjusted to cause an output voltage 213 to be at a desired level.

In FIG. 2, the output voltage 213 may need to be greater than the band-gap voltage $V_{BG}$ in order to function properly. This may make it difficult to provide an output voltage 213 which is near or below the magic voltage of the band-gap reference circuit. The gain stage which includes the error amplifier 201 adds to the needed circuitry and may introduce noise which may be difficult to filter out.

FIG. 3 illustrates a prior art example of the temperature stability of the voltage-mode band-gap reference circuit illustrated in FIG. 2 as a function of different temperature drift trim settings. Each line represents a different temperature drift trim setting of the temperature drift trim potentiometers 207 and 209.

Figure 4:
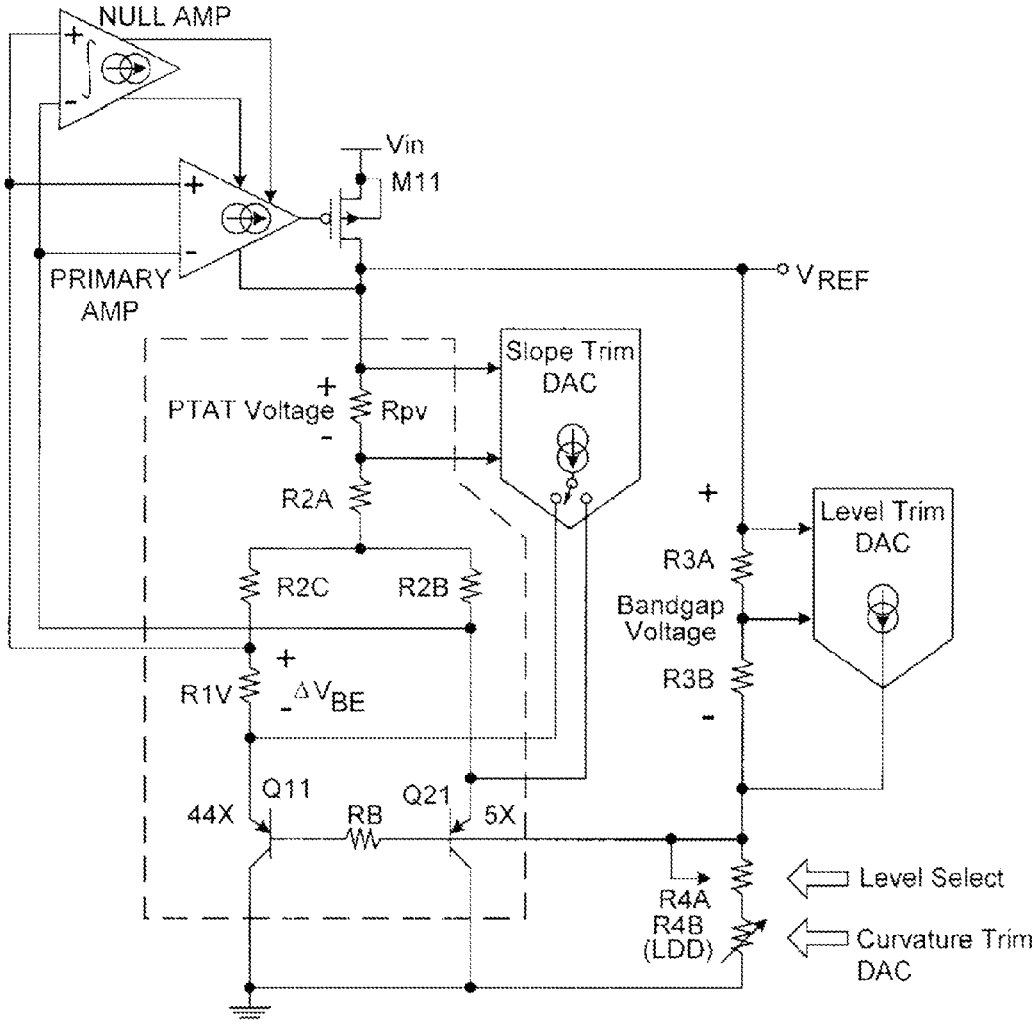
Fig. 4 (Prior Art)
FIG. 4 illustrates a prior art example of a voltage-mode band-gap reference circuit with a temperature drift trim setting device and an output voltage trim setting device located within the voltage-mode band-gap reference circuit.

FIG. 4 illustrates a prior art example of a voltage-mode band-gap reference circuit with a temperature drift trim setting DAC (labeled a Slope Trim DAC) and an output voltage trim setting (labeled a Level Trim DAC), both located within the voltage-mode band-gap reference circuit. A PTAT voltage is generated across Rpv to control the Slope Trim DAC. The Slope Trim DAC injects PTAT current into the emitters of Q11 and Q21 to adjust the linear temperature drift of the reference. The output voltage $V_{REF}$ may be trimmed with the Level Trim DAC which injects a single ended constant current onto the base of Q21. A constant current may be derived from the constant voltage across R3A and used to create injection current.

Resistors R3A and R3B may be required to facilitate the adjustment in the output voltage $V_{REF}$. The reference loop adjusts $V_{REF}$ so that it creates a constant band-gap voltage (or magic voltage) across R3A and R3B. This magic voltage, Vmagic, is controlled by the process parameters inherent in the Q11 and Q21 transistors. To trim accuracy, the magic voltage is multiplied by a ratio of resistors, (R4A+R4B)/(R3A+R3B): $V_{REF}$=Vmagic*(1+(R4A+R4B)/(R3A+R3B)).

The Level Trim DAC gives fine adjustments (or trim) to $V_{REF}$ by injecting additional current into R4A+R4B and has the same effect as adjusting R3A+R3B. In effect, the Level Trim DAC adjusts the effect of R3A+R4B to provide the output voltage trim.

This trim circuit may only be able to produce $V_{REF}$ voltages greater than the inherent "magic" voltage of the band-gap circuit. In addition, the difference between $V_{REF}$ and Vmagic may need to be large enough to support the drop across R4A and R4B.

The voltage drop across R4B may be necessary for this circuit's output voltage adjustment and non-linear temperature drift (or curvature) correction. Because R4A and R4B are integral to defining the output voltage $V_{REF}$, this reference may need to produce output voltages significantly greater than the inherent magic voltage. This circuit may therefore not be able to trim the accuracy of $V_{REF}$ voltages at or near the magic voltage.

More details about this circuit may be obtained from U.S. Pat. No. 6,329,804, content of which is incorporated herein by reference.

Figure 5:
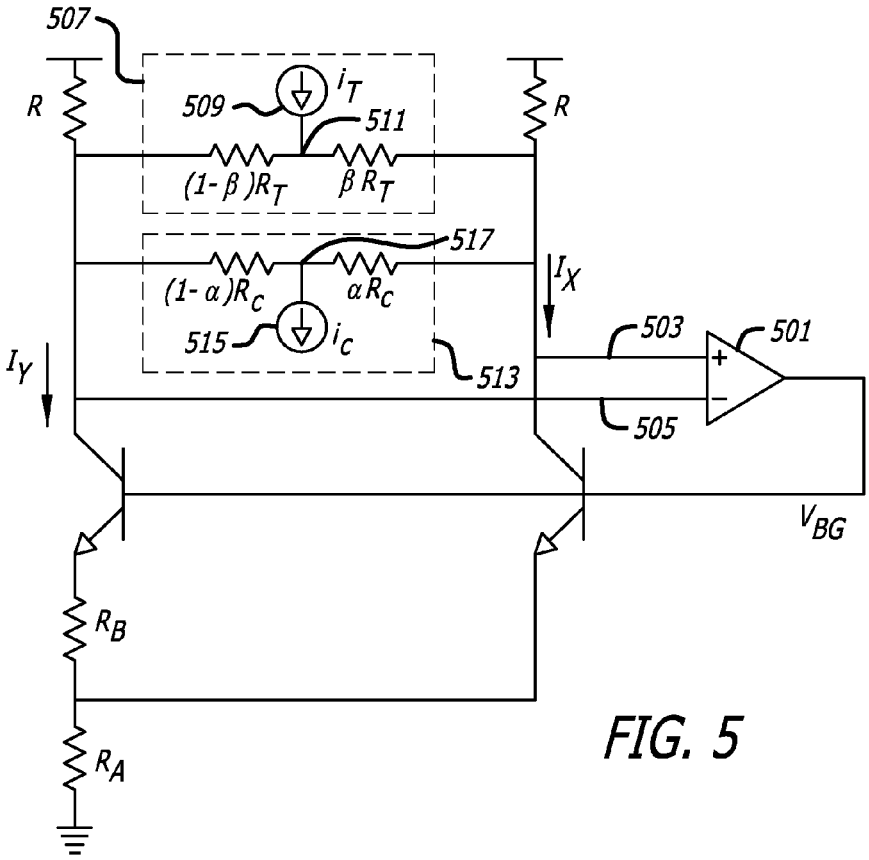
FIG. 5 illustrates an example of a voltage-mode band-gap reference circuit with a temperature independent differential current source and a temperature dependent differential current source, each within the voltage-mode band-gap reference circuit.

FIG. 5 illustrates an example of a voltage-mode band-gap reference circuit with a temperature independent differential current source and a temperature dependent differential current source, each within the voltage-mode band-gap reference circuit.

As illustrated in FIG. 5, the voltage-mode band-gap reference circuit includes an error amplifier 501 having differential input nodes 503 and 505.

A temperature dependent differential current source 507 may be configured to add in or subtract from the differential input nodes a substantially temperature dependent differential current with an allocation between the nodes that is controlled by a selectable temperature-drift trim setting. The temperature dependent differential current source 507 may include a temperature dependent current source 509 injected into a cursor 511 of a potentiometer $R_T$ (illustrated in FIG. 5 as two separate resistors).

The temperature dependent current source 509 may be of any type. For example, a proportional to absolute temperature (PTAT) or complementary to absolute temperature (CTAT) current source may be used. All references to "current source" are to the circuitry which delivers a current, not to the actual source of electrical energy.

A temperature independent differential current source 513 may be configured to add in or subtract from the differential input nodes 503 and 505 a substantially temperature independent differential current with an allocation between the nodes that is controlled by a selected temperature-drift trim setting. The temperature independent differential current source 513 may include a temperature independent current source 515 which is injected into a cursor 517 of a potentiometer $R_C$.

The temperature independent current source 515 may be of any type. Circuits which may be used to produce such temperature dependent currents may include circuits which add up PTAT and CTAT currents or voltage-to-current converters which use a reference voltage as input signals.

The following equations may determine the output voltage $V_{BG}$:

$$I_X = I_Y + (2\alpha - 1)i_C - (2\beta - 1)i_T$$

$$V_{BG} = \theta + (I_x + I_Y)R_A$$

$$V_{BG} = \theta + 2I_Y R_A + (2\alpha - 1)i_C R_A - (2\beta - 1)i_T R_A$$

where $\theta = V_{be}$, $$I_y = V_T \frac{\ln N}{R_B},$$

N=the area ratio of the BJT emitters, $$V_{magic} = \theta + 2I_Y R_A = V_{BE} + 2V_T \ln N \frac{R_A}{R_B}.$$

Note also that $(2\alpha-1)i_C R_A$ is a constant term and $-(2\beta-1)i_T R_A$ is a temperature drift term.

The magic voltage may be the value of the band-gap reference output at zero scale, that is for $\alpha=\beta=0.5$:

$$V_M = \theta + 2I_y R_A$$

$$V_C i_C R_A$$

$$V_T = i_T R_A$$

$$V_{BG} = V_M + (2\alpha - 1)V_C - (2\beta - 1)V_T$$

This last set of equations may define linear and independent constant voltage, α, and PTAT voltage, β, trims. Trim linearity and independence may be achieved when $V_c/V_{BG}$ and $V_T/V_{BG}$ are both much less than 1.

As illustrated in FIG. 5, the potentiometers of the two differential current sources may be connected substantially in parallel. As also illustrated in FIG. 5, one of the differential current sources may be configured to addcurrent to the differential input nodes 503 and 505, while the other differential current source may be configured to subtract current from the differential input nodes 503 and 505.

Each differential current source may be configured to cause the sum of the differential currents which it injects into or subtracts from the differential input nodes to be substantially constant, notwithstanding changes in the selectable trim setting of the differential current source.

The cursor location of each potentiometer $R_T$ and $R_C$ may be digitally controlled, thus causing the location of the cursor to move in increments in response to changes in the digital word.

As illustrated in FIG. 5, both differential current sources may be within the voltage-mode band-gap reference circuit.

The voltage-mode band-gap reference circuit may have a magic voltage at which the temperature stability of the circuit is maximized. The voltage-mode band-gap reference circuit may be configured to operate with a supply voltage which is not substantially larger than this magic voltage. The temperature dependent differential current source 513 illustrated in FIG. 5 may also be configured to cause an output voltage $V_{BG}$ to be near or below this magic voltage.

Figure 6:
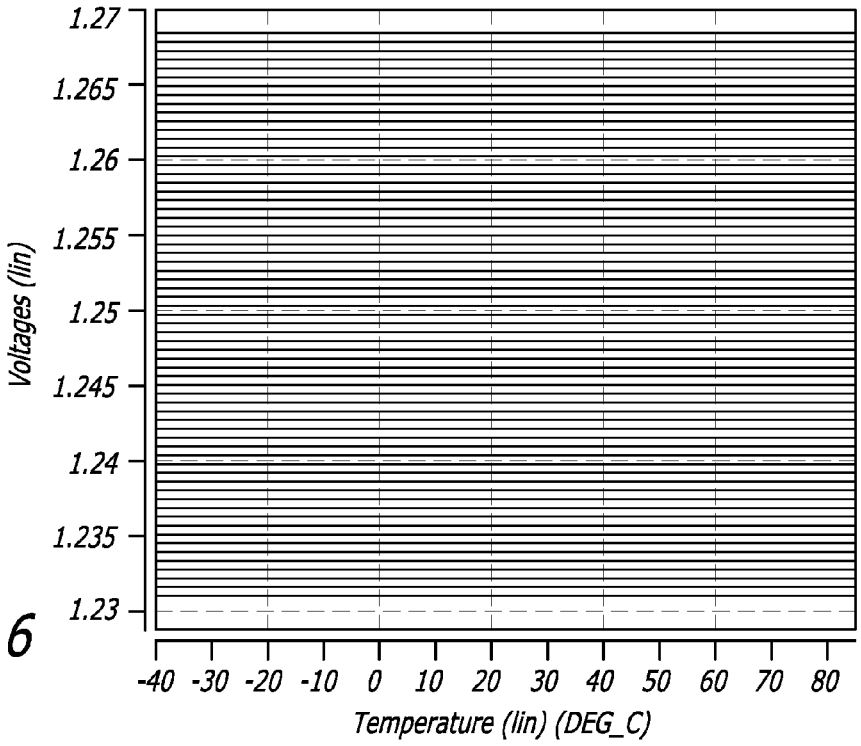
FIG. 6 illustrates an example of the effect of different output voltage trim settings in the temperature independent differential current source illustrated in FIG. 5.

FIG. 6 illustrates an example of the effect of different output voltage trim settings in the temperature independent differential current source illustrated in FIG. 5. Each horizontal line in FIG. 6 may represent the temperature drift of the circuit illustrated in FIG. 5 at a particular output voltage trim setting of the potentiometer $R_T$.

FIG. 7 illustrates an example of the effect of different temperature drift trim settings in the temperature dependent differential current source illustrated in FIG. 5. Each line in FIG. 7 may represent the temperature drift of the circuit at a particular temperature drift trim setting of the potentiometer $R_T$.

At a particular temperature, such as at room temperature, the component values in the circuit illustrated in FIG. 5 may cause the incremental change in output voltage caused by an incremental change in the selectable output voltage trim setting to be the same as the incremental change caused by an incremental change in the selectable temperature drift trim setting.

FIG. 8 illustrates an example of the effect of different sets of paired output voltage trim settings and temperature drift trim settings in the voltage-mode band-gap reference circuit illustrated in FIG. 5. Each line in FIG. 8 represents the temperature drift of the output voltage based upon a particular output voltage trim setting and a particular temperature drift trim setting. Each pair of settings may be selected so as to cause the value of the output voltage to be the same at a particular temperature, such as at room temperature. This is illustrated by the single point at which all of the lines cross in FIG. 8. Details about this selection process are set forth below in connection with the discussion of FIG. 12.

Figure 9:
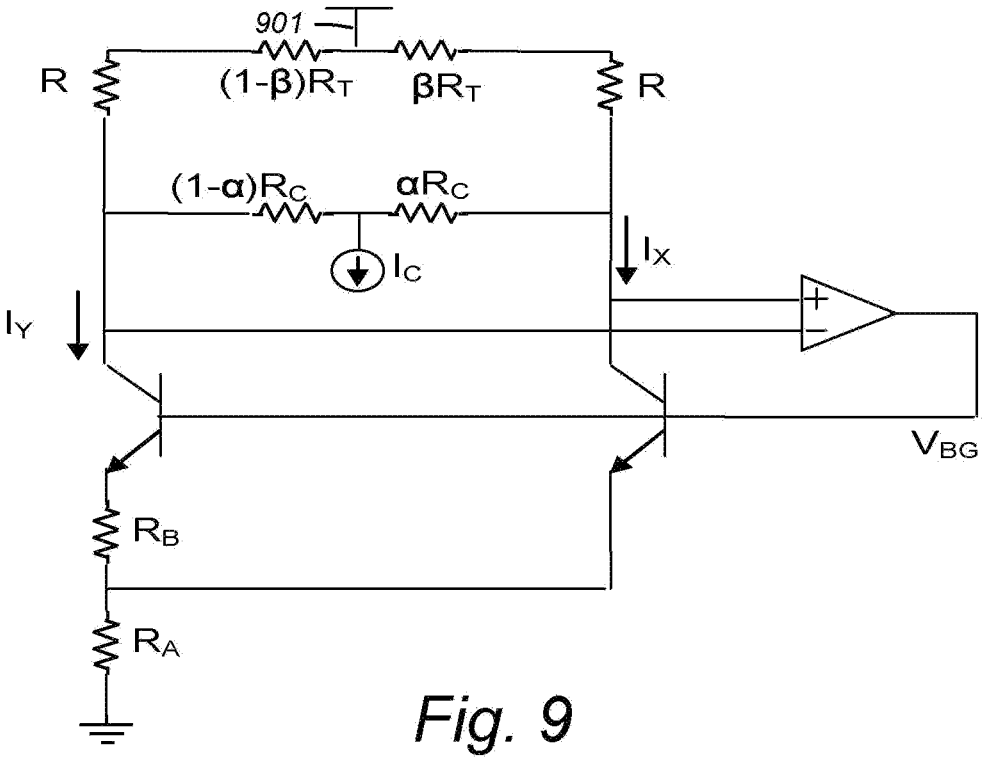
FIG. 9 illustrates another example of a voltage-mode band-gap reference circuit with a temperature independent differential current source and a temperature dependent differential current source, each within the voltage-mode band-gap reference circuit.

FIG. 9 illustrates another example of a voltage-mode band-gap reference circuit with a temperature independent differential current source and a temperature dependent differential current source, each within the voltage-mode band-gap reference circuit. FIG. 9 represents a particular implementation of the circuit illustrated in FIG. 5 in which $R_T \ll R$, $I_C \ll I_X$, and $I_C \ll I_Y$. In this situation:

$$V_{BG}=V_M-(2\beta-1)V_T+(1-2\alpha)V_C$$

$$VM = \theta + 2\frac{RA}{RB}\cdot\frac{kT}{q}\cdot\ln N,\ V_T = \frac{R_A}{R_B}\cdot\frac{R_T}{R}\cdot\frac{kT}{q}\ln N,$$

$$V_C=I_C\cdot R_A$$

$\theta=V_{be}$ of the BJT device. N=area ratio of the BJT device emitters.

This enables the independent current source 509 which is used in the temperature dependent differential current source 507 in FIG. 5 to be a PTAT supplied through the voltage supply line 901. The equations set forth about in connection with FIG. 5 may otherwise be the same.

Figure 10:
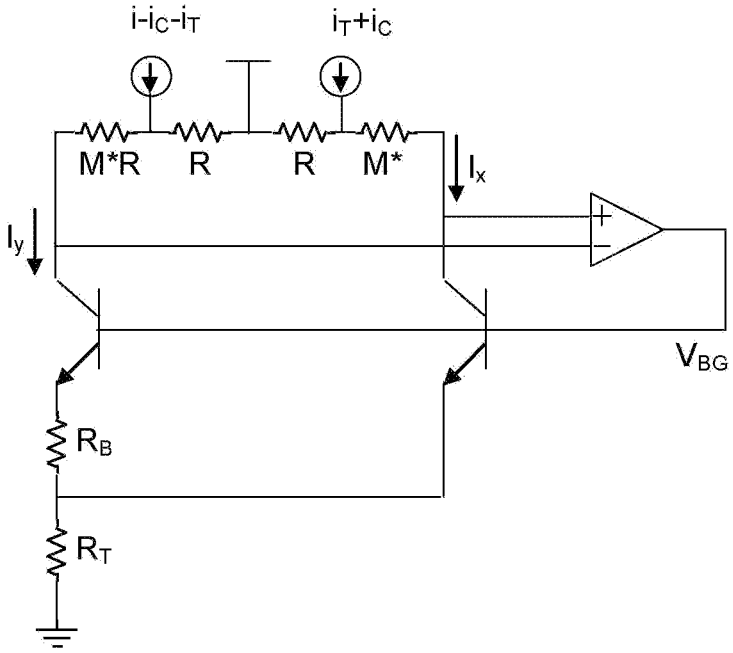
FIG. 10 illustrates another example of a voltage-mode band-gap reference circuit with a temperature independent differential current source and a temperature dependent differential current source, each within the voltage-mode band-gap reference circuit.

FIG. 10 illustrates another example of a voltage-mode band-gap reference circuit with a temperature independent differential current source and a temperature dependent differential current source, each within the voltage-mode band-gap reference circuit. R may represent the resistance of an R2R ladder, $i_C$ may be a constant binary weighted current DAC derived from $V_{BG}$/Rx and the R2R ladder, and $I_T$ may be a binary weighted PTAT current DAC derived from $(V_{BG}-V_{BE})/R_y$ and the R2R ladder, where i is the constant source of the two differential time constants: $(i-i_C-i_T)+(i_C+i_T)=i$=constant.

The following equations may determine the output voltage:

$$V_{BG}=V_M(1-\alpha)-\beta(V_M-\theta)$$

Where $\theta$ is $V_{BE}$, a BJT base emitter junction voltage, and $V_M$ is the magic constant voltage of the band-gap circuit and $\alpha$ and $\beta$ are the settings or trims. This last equation may define linear and independent constant voltage, $\alpha$, and PTAT voltage, $\beta$, trims. Trim linearity and independence may be achieved when $\alpha$ and $\beta$ are both much less than 1.

Figure 11:
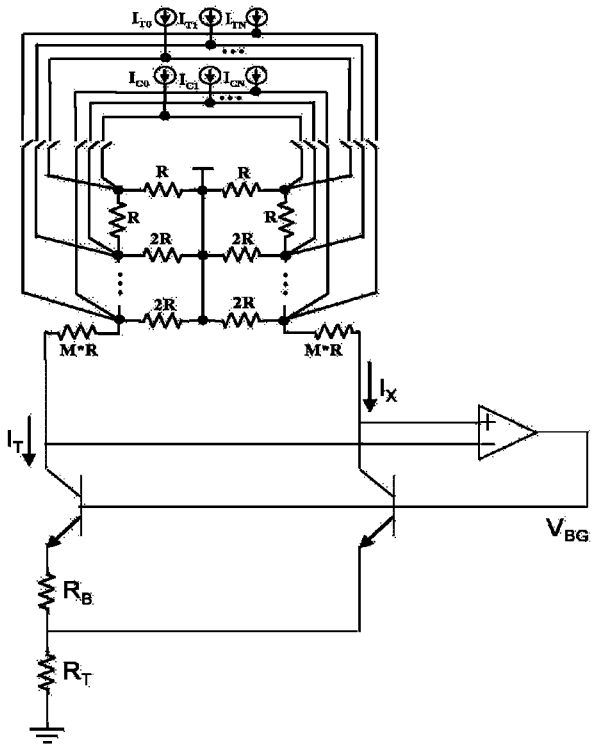
FIG. 11 illustrates an example of the voltage-mode band-gap reference circuit which is illustrated in FIG. 10 using R2R ladders in each of the differential current sources.

FIG. 11 illustrates an example of the voltage-mode band-gap reference circuit which is illustrated in FIG. 10 using R2R ladders in each of the differential current sources. This may be an efficient R2R ladder constant and PTAT current DAC implementation. An array of equal constant current sources, $I_{C0\text{-}N}$, and the R2R ladder implement the $i_C$ programmable constant current source in FIG. 10. An array of equal PTAT current sources, $I_{T0\text{-}N}$, and the same R2R ladder used to generate $i_C$ creates the $i_T$ PTAT current DAC in FIG. 10. If the DAC trim code is "m" and the number of trim bits is "n", then:

$$i_C=mI_{C0}$$

$$i_T=mI_{T0}$$

$$i=2^n(I_{C0}+I_{T0})$$

Figure 12:
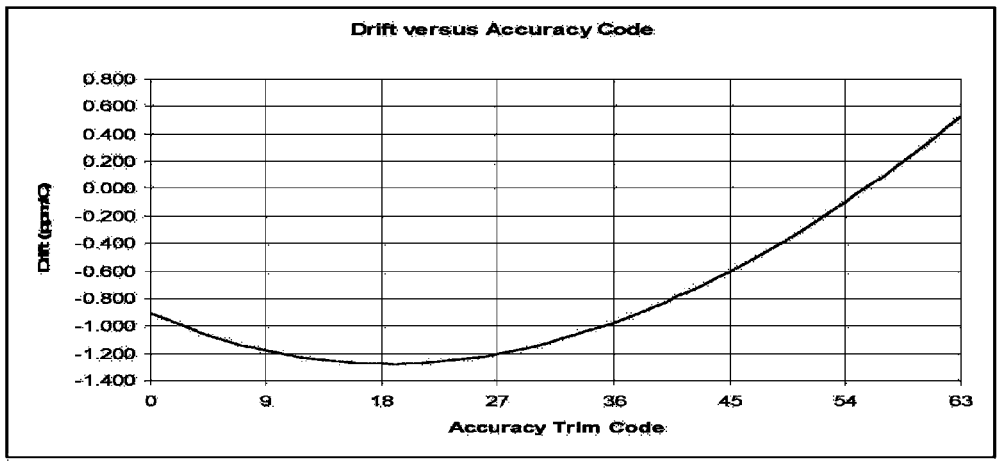
FIG. 12 illustrates an example of simulated drift variation as a function of accuracy trim code in a +/−1.3% 6-bit accuracy R2R ladder trim DAC implementation.

FIG. 12 illustrates an example of simulated drift variation as a function of accuracy trim code in a +/−1.3% 6-bit accuracy R2R ladder trim DAC implementation.

Figure 13:
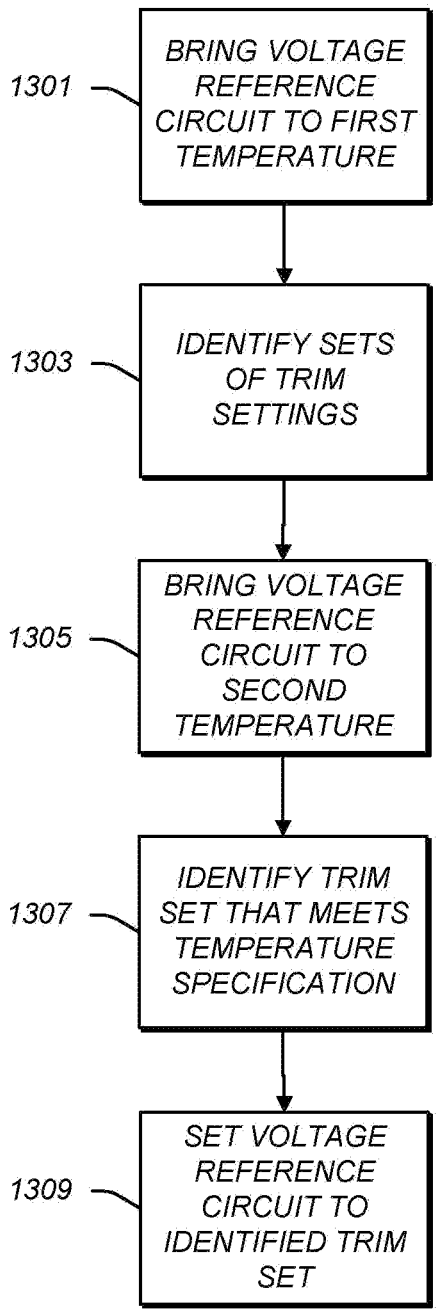
FIG. 13 illustrates a process for trimming a monolithic voltage reference circuit after it is manufactured which has selectable temperature drift trim settings and selectable output voltage trim settings.

FIG. 13 illustrates a process for trimming a monolithic voltage reference circuit after it is manufactured which has selectable temperature drift trim settings and selectable output voltage trim settings. The process illustrated in FIG. 13 may be used in connection with the monolithic voltage reference circuits illustrated in FIGS. 5, 9, 10, and 11, or in connection with a different type of monolithic voltage reference circuit. Similarly, the monolithic voltage reference circuits illustrated in FIGS. 5, 9, 10, and 11 may be trimmed using a different process.

The monolithic voltage reference circuit may be brought to a first temperature as illustrated by a Bring Voltage Reference to First Temperature step 1301. During this step, the voltage reference circuit may be heated or cooled to the first temperature or, if the first temperature is room temperature, simply left in the room until it reaches this room temperature.

While at the first room temperature, sets of trims may be identified, as reflected by an Identify Sets of Trim Settings 1303. Each set may consist of one of the selectable drift settings and one of the selectable output voltage trim settings. When the trims are digitally controlled, for example, each trim setting may be a digital word representing the trim setting.

Each set of trim settings may be selected to collectively cause an output of the monolithic voltage reference circuit to be substantially at a pre-determined level which is substantially the same for each set while at the first temperature. The following table illustrates an example of the sets of trim settings which may be identified while at the first temperature:

| Temperature Drift Trim Setting | Output Voltage Trim Setting | Resulting Output Voltage At First Temperature |
|---|---|---|
| 0 | 7 | 1.2 V |
| 1 | 6 | 1.2 V |
| 2 | 5 | 1.2 V |
| 3 | 4 | 1.2 V |
| 4 | 3 | 1.2 V |
| 5 | 2 | 1.2 V |
| 6 | 1 | 1.2 V |
| 7 | 0 | 1.2 V |

Any means may be used to identify these sets of trim settings. For example, the monolithic voltage reference circuit may be set to each of the temperature drift trim settings while at the first temperature. While at each temperature drift trim setting, the output voltage trim setting may be selected which causes the output of the monolithic voltage reference circuit to be substantially at the pre-determined level at the first temperature.

Conversely, the monolithic voltage reference circuit may be set to each of the output voltage trim settings while at the first temperature. While at each output voltage trim setting, the temperature drift trim setting may be selected which causes the output of the monolithic voltage reference circuit to be substantially at the pre-determined level.

Examples of other techniques which may be used to identify these sets of trim settings may include linear search, binary search, trim settings matched by design, or any other method that identifies the sets of trims at the first temperature. The monolithic voltage reference circuit may then be brought to a second temperature, as reflected by a Bring Voltage Reference Circuit to Second Temperature step 1305. For example, the voltage reference circuit may be heated or cooled to a temperature which is above or below the room temperature. This may be accomplished by any means. For example, the heating may be accomplished by activating a heating element embedded within the monolithic voltage reference circuit.

While at the second temperature, one of the sets of trim settings may be identified which causes the monolithic voltage reference circuit to meet a temperature drift specification, as reflected by an Identify Trim Set That Meets Temperature Drift Specifications step 1307. This step may be accomplished by any means. For example, the voltage reference circuit may be set in accordance with each of the identified sets of trim settings, and the particular set of trim settings which causes the output voltage of the voltage reference circuit to be within the desired temperature specification may be selected. The set of trim settings which is selected may also be the set which causes the monolithic voltage reference circuit to exhibit the lowest possible temperature drift. Other techniques for identifying the set of trim setting which causes the circuit to meet the temperature drift trim specification include trying all codes, linear search, binary search, or other techniques.

The voltage reference circuit may then be set in accordance with the set of trim settings which has been identified, as reflected by a Set Voltage Reference Circuit to Identify Trim Set step 1309. The voltage reference circuit may then be optimized for both temperature drift and voltage accuracy.

The components, steps, features, objects, benefits and advantages which have been discussed are merely illustrative. None of them, nor the discussions relating to them, are intended to limit the scope of protection in any way. Numerous other embodiments are also contemplated. These include embodiments which have fewer, additional, and/or different components, steps, features, objects, benefits and advantages. These also include embodiments in which the components and/or steps are arranged and/or ordered differently.

For example, a single physical potentiometer may be used in lieu of the dual potentiometers which have been illustrated with two independent sets of cursor tap points.

Unless otherwise stated, all measurements, values, ratings, positions, magnitudes, sizes, and other specifications which are set forth in this specification, including in the claims which follow, are approximate, not exact. They are intended to have a reasonable range which is consistent with the functions to which they relate and with what is customary in the art to which they pertain.

All articles, patents, patent applications, and other publications which have been cited in this disclosure are incorporated herein by reference.

The phrase "means for" when used in a claim is intended to and should be interpreted to embrace the corresponding structures and materials which have been described and their equivalents. Similarly, the phrase "step for" when used in a claim is intended to and should be interpreted to embrace the corresponding acts which have been described and their equivalents. The absence of these phrases in a claim mean that the claim is not intended to and should not be interpreted to be limited to any of the corresponding structures, materials, or acts or to their equivalents.

The scope of protection is limited solely by the claims which now follow. That scope is intended and should be interpreted to be as broad as is consistent with the ordinary meaning of the language which is used in the claims when interpreted in light of this specification and the prosecution history which follows and to encompass all structural and functional equivalents. Notwithstanding, none of the claims are intended to embrace subject matter which fails to satisfy the requirement of Sections 101, 102, or 103 of the Patent Act, nor should they be interpreted in such a way. Any unintended embracement of such subject matter is hereby disclaimed.

Except as stated immediately above, nothing which has been stated or illustrated is intended or should be interpreted to cause a dedication of any component, step, feature, object, benefit, advantage, or equivalent to the public, regardless of whether it is or is not recited in the claims.

The invention claimed is:

1. A monolithic voltage reference circuit comprising:

a voltage-mode band-gap reference circuit with an error amplifier having differential input nodes;

a temperature independent differential current source configured to add in or subtract from the differential input nodes a substantially temperature independent differential current with an allocation between the nodes that is controlled by a selectable output voltage trim setting; and a temperature dependent differential current source configured to add in or subtract from the differential input nodes a substantially temperature dependent differential current with an allocation between the nodes that is controlled by a selectable temperature drift trim setting.

2. The monolithic voltage reference circuit of claim 1 wherein:

the temperature independent differential current source is configured to provide incremental selectable output voltage trim settings, the incremental selection of which causes a corresponding incremental change in the output voltage of the monolithic voltage reference circuit at a certain temperature; and the temperature dependent differential current source is configured to provide incremental selectable temperature drift trim settings, the incremental selection of which causes substantially the same corresponding incremental change in the output voltage of the monolithic voltage reference circuit at the same temperature.

3. The monolithic voltage reference circuit of claim 1 wherein each differential current source includes a potentiometer connected between the differential input nodes which has a controllable cursor whose position sets the selectable trim setting of the differential current source.

4. The monolithic voltage reference circuit of claim 3 wherein the potentiometers of the two differential current sources are connected substantially in parallel.

5. The monolithic voltage reference circuit of claim 4 wherein the cursor of the potentiometer of the temperature dependent differential current source is connected to a voltage supply line.

6. The monolithic voltage reference circuit of claim 3 wherein the potentiometers of the two differential current sources are connected substantially in series.

7. The monolithic voltage reference circuit of claim 1 wherein a single potentiometer connected between the differential input nodes is used as part of each differential current source, the single potentiometer having two independentlysettable cursors, the position of one of which sets the selectable trim setting of the temperature independent differential current source and the position of the other of which sets the selectable trim setting of the temperature dependent differential current source.

8. The monolithic voltage reference circuit of claim 1 wherein each differential current source includes an R2R resistor ladder.

9. The monolithic voltage reference circuit of claim 1 wherein one of the differential current sources is configured to inject current into the differential input nodes and the other differential current source is configured to subtract current from the differential input nodes.

10. The monolithic voltage reference circuit of claim 1 wherein each differential current source is configured to cause the sum of the differential currents which it injects into or subtracts from the differential input nodes to be substantially constant, notwithstanding changes in the selectable trim setting of the differential current source.

11. The monolithic voltage reference circuit of claim 1 wherein:

both differential current sources are within the voltage-mode band-gap reference circuit;

the voltage-mode band-gap reference circuit has a magic voltage at which the temperature stability of the circuit is maximized; and the voltage-mode band-gap reference circuit is configured to operate with a supply voltage which is not substantially larger than the magic voltage.

12. The monolithic voltage reference circuit of claim 1 wherein:

the voltage-mode band-gap reference circuit has a magic voltage at which the temperature stability of the circuit is maximized; and the selectable output voltage trim setting may be set to cause the output voltage to be near or below the magic voltage.

13. A process for trimming a monolithic voltage reference circuit after it is manufactured which has selectable temperature drift trim settings and selectable output voltage trim settings comprising:

causing the monolithic voltage reference circuit to be at a first temperature;

while at the first temperature, identifying sets of trim settings, each of which consists of one of the selectable temperature drift trim settings and one of the selectable output voltage trim settings which collectively cause an output of the monolithic voltage reference circuit to be substantially at a pre-determined level which is substantially the same for each set;

causing the monolithic voltage reference circuit to be at a second temperature which is different from the first temperature;

while at the second temperature, identifying one of the sets of trim settings which causes the monolithic voltage reference circuit to meet a temperature drift specification; and setting the temperature drift trim setting and the output voltage trim setting of the monolithic voltage reference circuit to their respective values in the identified set of trim settings.

14. The process of claim 13 wherein the identifying the one set of trim settings includes identifying the one set of trim settings which causes the output of the monolithic voltage reference circuit to exhibit the lowest temperature drift.

15. The process of claim 13 wherein the first temperature is room temperature and the second temperature is higher than the room temperature.

16. The process of claim 13 wherein the identifying the sets of trim settings includes setting the monolithic voltage reference circuit to each of the temperature drift trim settings and, while set at each temperature drift trim setting, finding the output voltage trim setting which causes the output of the monolithic voltage reference circuit to be substantially at the pre-determined level.

17. The process of claim 13 wherein the identifying sets of trim settings includes setting the monolithic voltage reference circuit to each of the output voltage trim settings and, while set at each output voltage trim setting, finding the temperature drift trim setting which causes the output of the monolithic voltage reference circuit to be substantially at the pre-determined level.

18. The process of claim 13 wherein the monolithic voltage reference circuit is a band-gap reference circuit.

19. The process of claim 18 wherein the band-gap reference circuit is a voltage mode band-gap reference circuit.

* * * * *